US005405011A

United States Patent [19]

Haber et al.

[11] Patent Number: 5,405,011

[45] Date of Patent: Apr. 11, 1995

[54] BLISTER PACK PILL DISPENSER

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Laguna Hills, Calif.

[21] Appl. No.: 240,955

[22] Filed: May 11, 1994

Related U.S. Application Data

[63] Continuation of Ser. No. 958,010, Oct. 8, 1992, abandoned.

[51] Int. Cl.[6] ..... B65D 83/04

[52] U.S. Cl. ..... 206/531; 206/533; 206/536; 221/25; 221/88

[58] Field of Search ..... 221/25, 88, 87, 262, 221/273, 130; 206/528, 531, 532, 535, 536, 537, 533; 53/169, 235

[56] References Cited

U.S. PATENT DOCUMENTS

| | | | |
|---|---|---|---|
| 3,654,890 | 4/1972 | Rigney et al. | 206/536 X |
| 4,154,365 | 5/1979 | Lorca | 206/536 X |
| 4,733,797 | 3/1988 | Haber | 221/25 X |
| 5,099,999 | 3/1992 | Balien | 206/536 |
| 5,141,129 | 8/1992 | Jennings | 206/536 X |

*Primary Examiner*—Jacob K. Ackun, Jr.
*Attorney, Agent, or Firm*—Townsend & Townsend Khourie & Crew

[57] ABSTRACT

A dispenser for receiving and dispensing oral solid drugs from prior art a blister pack singulates and dispenses oral solid drugs. The dispenser for the blister pack includes a cylindrical cage defining at least one recess for keying to one or more of the blisters of the blister pack, the cage having a sufficient cylindrical dimension to permit the blister pack to be wrapped around the cage in a cylindrical disposition. A cylindrical dispenser container having a cylindrical inside dimension sufficient to receive the outside cylindrical diameter of the blister pack as disposed over the cage receives the cage and wrapped blister pack. This cylindrical container defines through the cylindrical side wall a dispensing window having a dimension sufficient to permit an oral solid drug dispensed from the blister pack to pass through the dispensing window. A rotational rachet successively registers to the dispensing window discrete blisters from the blister pack. An internal lever overlying the dispensing window is actuated by a cam rod for depressing the blisters overlying the dispensing window for causing oral solid drugs within a blister overlying the dispensing window to be dispensed from the blister through the dispensing window. The cam rod, connected to a supporting base for the cylindrical container, allow dispensing to occur by depressing the container toward the base of the unit. Additionally, provision is made for registering successive rows of the blister pack to the elevation of the dispensing window so that the rows of the blister pack can be successively dispensed.

16 Claims, 12 Drawing Sheets

BLISTER PACK PILL DISPENSER

This is a continuation of application Ser. No. 07/958,010, filed Oct. 8, 1992, now abandoned.

This invention relates to a blister pack oral solid dispensing device. Specifically, the invention herein takes a standard and prior art blister pack product rolled and loaded into the interior of the cylindrical pill dispenser disclosed herein. Thereafter, pills are singularly dispensed remotely from the blister pack through an orifice in the side of the dispenser. Provision is made to register sequentially discrete blisters within the blister pack for individual oral solid dispensing at each row of the blister pack as well as to sequentially register the rows of the blister pack to a dispensing elevation as each row is emptied. Additionally, provision is made for reloading and consequent recycling of the dispenser as an aid to pharmaceutical dispensing.

BACKGROUND OF THE INVENTION

So-called "blister packs" are a known, relatively easy method for singulating, transporting, storing and finally dispensing oral solid drugs. Such packs include a planar transparent piece of plastic provided with "blisters" or concave protrusions configured in rows and columns. Each of the blisters or concave protrusions is sized to receive a singulated capsule of the particular oral solid drug being dispensed.

Typically, at least one backing layer is fastened to the solid receiving side of the blister pack. This layer is a low strength retaining barrier. This low strength retaining layer stretches across the backs of the blisters and retains the singulated oral solid drugs individually sealed within each of the blisters.

Dispensing of drugs from such blister packs is well known and easy to understand. The consumer presses down on a blister from the convex side of the blister. Such pressing bears directly against the singulated oral solid drug contained in the concave side of the discrete blister. The singulated oral solid drug is then forced through the low strength retaining barrier. This low strength retaining barrier at least partially tears and breaks away. During this partial breaking and tearing away, the singulated oral solid drug is partially—but typically not totally—ejected from its individual blister. Preferably, it is during this partial ejection that the oral solid drug is grasped by the user and consumed as directed. There results a safe, sterile dispensing of the drug in singulated dosages from the blister pack.

While such blister packs constitute an advantageous dispensing mechanism—this mechanism can admit of improvement. Many patients are too ill or feeble to manipulate the blisters. Further, in the hospital environment, where pills are given to the patient rather than the patient being relied upon to take his own prescribed dosages, the blister pack is other than optimum. Consequently, in the following disclosure, a mechanism for the automated dispensing of oral solid drugs from a blister pack is set forth.

SUMMARY OF THE INVENTION

A mechanism for dispensing oral solid drugs from a blister pack having rows and columns of singulated oral solids within a pre-loaded blister pack is disclosed. The mechanism includes a cylindrical cage having discrete blister windows in the outside wall of the cylinder—each window defining an internal dimension sufficient to key to one or more blisters of the blister pack. The total diameter of the cylindrical cage accommodates the total number of blisters in a row of the blister pack as it is wrapped around the cage. As a consequence, the blister pack can be wrapped around the cage from the outside with the blisters protruding to the inside and form an extended generally cylindrical configuration to the flat exterior of the blister pack.

Once such wrapping of the cage mechanism occurs, insertion of the now cylindrical blister pack occurs to a receiving—correspondingly cylindrical dispenser container. This cylindrical dispenser container receives and confines the cylindrically rolled blister pack attached at the top row and extending downward from the point of keying to the cylindrical cage.

The cylindrical dispenser container includes a dispensing window configured within a rotating section of the cylindrical dispenser container. This rotating section rotates over a rotational rachet mechanism. The rotational rachet mechanism serves to sequentially and individually register the dispensing window overlying the break away layer underlying each blister of a row of blisters in the cylindrically rolled blister pack. Thus, and upon rotation against the rotational rachet mechanism, each sequential blister is sequentially registered to the dispensing window in the cylindrical dispenser container.

The cylindrical dispenser container includes an internal dispensing lever. This lever is located at a pivot adjacent the vertical axis of the cylindrical dispenser container and rocks into and out of contact with the blisters of the blister pack responsive to a cam rod. The lever is fixed in relation to the dispensing window within the cylindrical dispensing container so that the lever moves towards and away from the dispensing window. When a blister is registered to the dispensing window, rocking of the dispensing lever into contact with the blister effects dispensing of the contained oral solid drug within that particular blister.

In the preferred embodiment, the container is supported on the cam rod which actuates the dispensing lever. This cam rod extends from the bottom of the dispenser container along the cylindrical axis of the dispenser container. Such support occurs at a base integral to the end of the cam rod, this base having a sufficient dimension to permit the dispenser to be supported in the upright position with the axis of the cylindrical dispenser container vertically disposed.

The cam rod is spring biased with respect to the rest of the dispenser. When the body of the dispenser is moved vertically downward against the spring bias, actuation of the dispensing lever occurs.

The dispensing lever is provided with a bias normally away from the dispensing window. Under actuation of the cam rod, the lever moves onto and collapses preferably one end of a blister registered to the lever from the inside of the cylindrically disposed blister pack. The result is that the lever pushes the contained oral solid drug through the break away layer and at least partially out the dispensing window in the cylindrical dispenser container. With the oral solid drug at least partially out of the dispensing window, the drug can be provided to the patient for ingestion as directed.

It will therefore be understood that by successive rotations against the rotational rachet and by corresponding successive actuations of the dispensing lever interior of the cylindrically rolled blister pack, singulated dispensing of the contained oral solid drug in the blister pack can occur.

There remains the need to register successive rows of the blister pack to the rotational path of the dispensing window within the cylindrical dispensing container. Accordingly, provision is made for moving the cage vertically against a vertical rachet. This vertical rachet includes a notched shaft which extends axially of the cylindrical dispensing container. The vertical rachet further includes a spring with opposed upwardly biased leaves bearing against the axially extending notched shaft. The cage is provided with a relatively high friction between the inside of the dispensing cylindrical container and the exterior of the cage for assisting operation of the vertical rachet.

Initially, the lowermost row of the cylindrically rolled blister pack is registered to the dispensing lever and dispensing window. When this row is fully dispensed, the vertical rachet shaft is lifted upwardly. The friction between the cage and the inside of the cylindrical dispensing container causes the cage to remain vertically stationary. The shaft however moves with respect to the cage with the opposed spring leafs sliding over the outside surface of the shaft. This sliding continues until a notch in the shaft is encountered. As the leafs spring into the notch, a telltale rachet setting proprioception is imparted to the user, informing the user that the vertical rachet is in registry for dispensing of the next blister pack row.

Once this telltale rachet setting proprioception occurs, the vertical rachet setting shaft is lowered. This time the leafs of the spring are biased into the notch on the shaft, causing the cage to remain at the same relative elevation with respect to the shaft. Downward force on the shaft results in downward force on the cage—which in turn overcomes the cage friction between in the inside of the cylindrical dispenser container and the outside of the cage. As a result, the cylindrically rolled blister pack moves downward one row. Thereafter, singulating rotational dispensing of the sequential blisters and contained oral solid drugs can occur for the next blister pack row.

It will be understood that normally blister packs contain at least three discrete rows. According, both the vertical rachet mechanism and the vertical dimension of the cylindrical dispensing container are configured to enable sufficient vertical excursion of the cylindrically rolled blister pack for dispensing from all three rows of the blister pack.

The disclosed blister pack dispensing container is advantageously used in conjunction with a pharmacy where the blister pack can be periodically reloaded. Accordingly, provision is made for sequential withdrawing of the cage from the cylindrical dispensing container. According to a preferred method disclosed herein, the spring of the vertical rachet mechanism for the cage is formed with a C-section. This C-section enables the spring leaves to be moved outwardly and away from the vertical rachet shaft holding the cage at its required elevation. Upon withdrawal of the spring, the shaft and attached cage can be moved free of the cylindrical dispensing container where the remainder of the previously installed blister pack can be removed and a new filled blister pack installed to the dispensing device. This withdrawal of the cage is preferably restricted to a single angular orientation of the top with respect to the base to enable disassembly for loading by pharmacy personnel.

BRIEF DESCRIPTION OF THE DRAWINGS

Other objects, features and advantages of the disclosed invention will be more apparent after referring to the following specification and attached drawings in which.

DESCRIPTION OF THE PREFERRED EMBODIMENT

Figure 1:
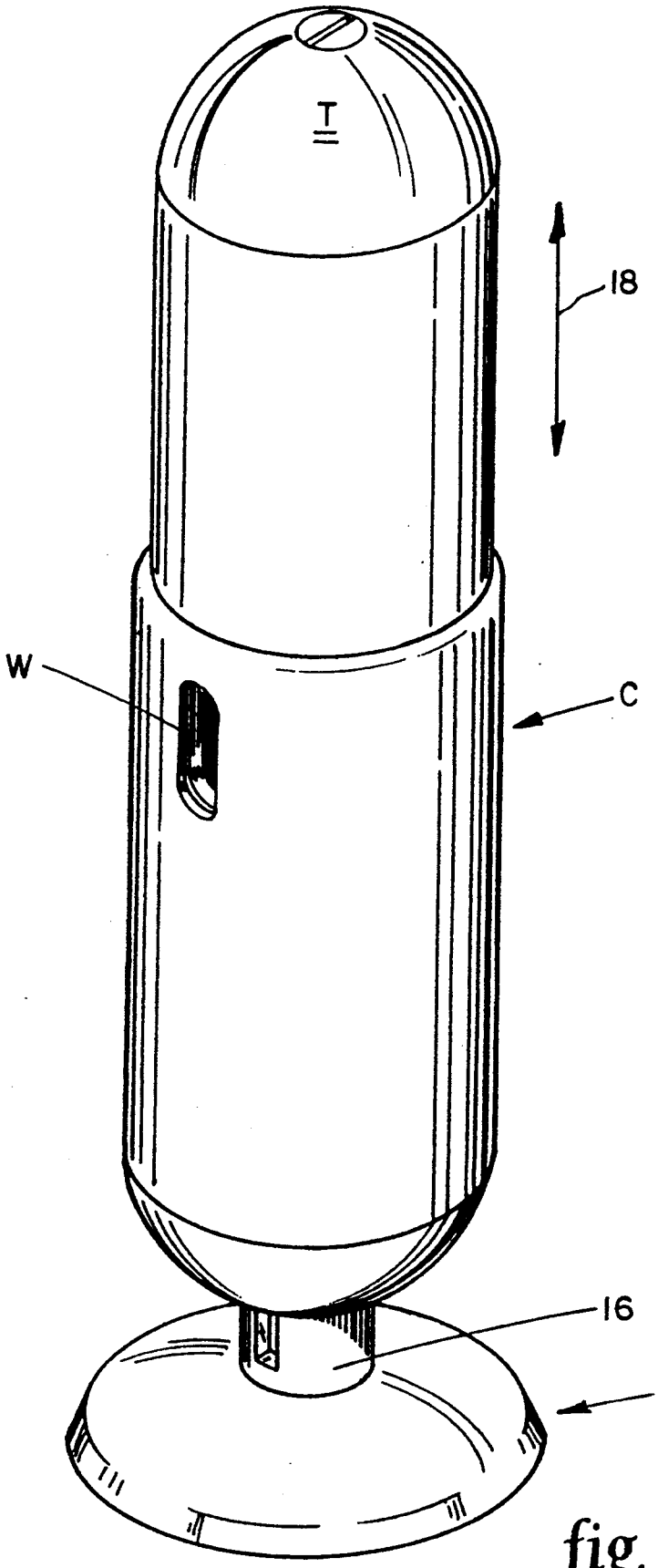
FIG. 1 is a perspective side elevation view of the complete dispenser.

Referring to FIG. 1, the dispenser of this invention is illustrated loaded with a blister pack. The dispenser includes a cylindrical dispenser container C having top T, base B with a container supporting shaft 16 extending between base B and dispenser container C. As will become apparent, upon vertical downward movement of dispenser container C relative to base B, singulated dispensing of an oral solid drug occurs through dispensing window W.

Having set forth the general operation of the device, the construction of the device will be described with respect to the exploded view of FIG. 2 and the side elevation section of FIG. 3. This explanation will occur in four discrete segments.

Figure 2:
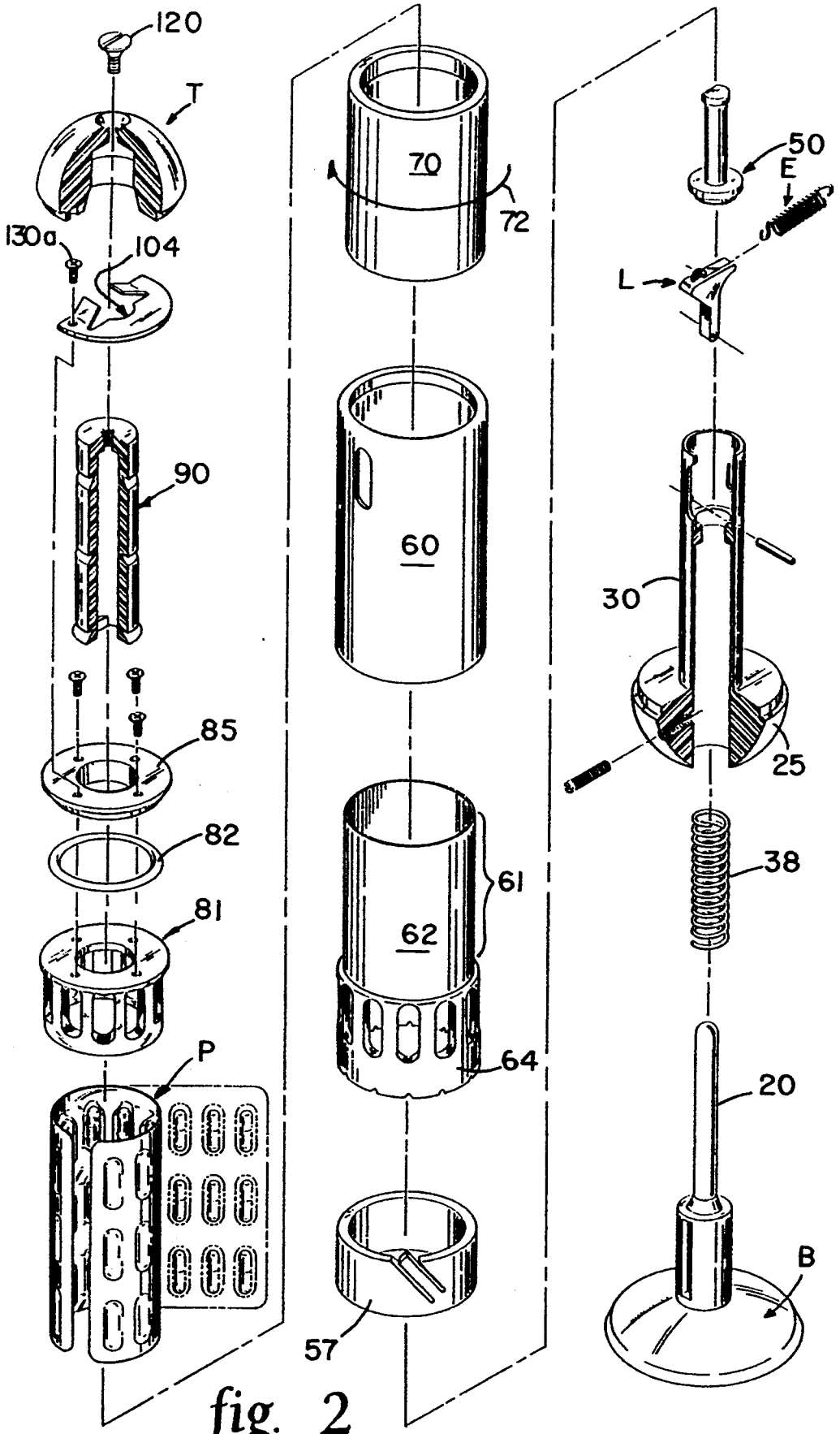
FIG. 2 is an exploded view of the discrete dispenser parts illustrating these part before their substantially concentric assembly for forming the dispenser of this invention, this exploded view also illustrating the blister pack in its relative relationship to the remainder of the exploded and illustrated parts.
Figure 2A:
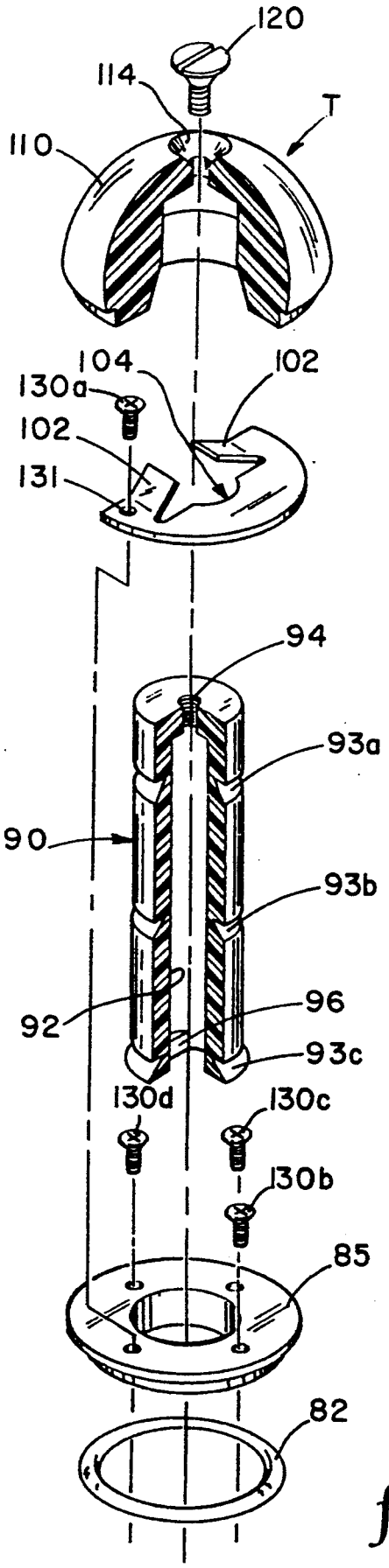
Figure 2B:
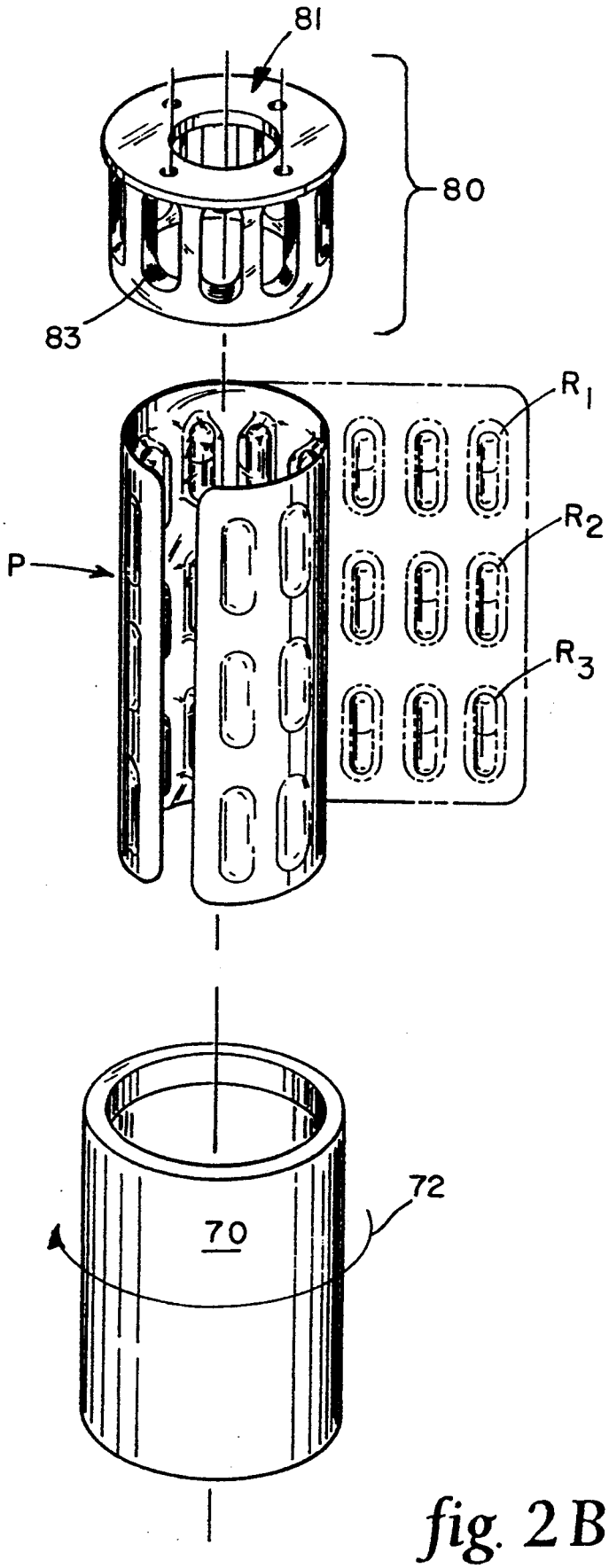
Figure 2C:
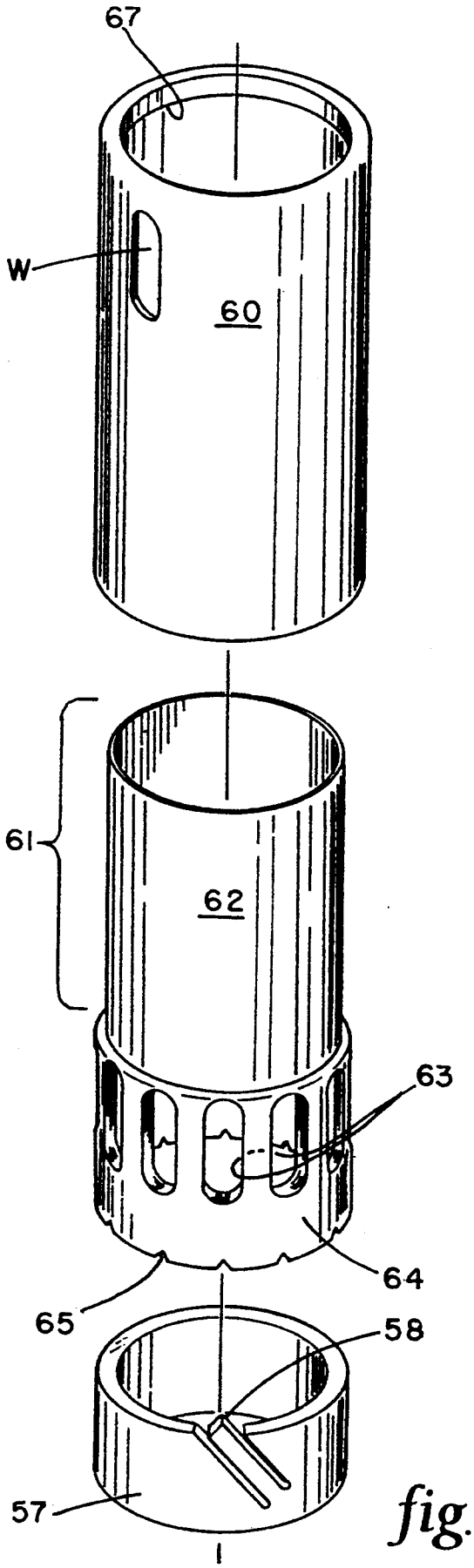
Figure 2D:
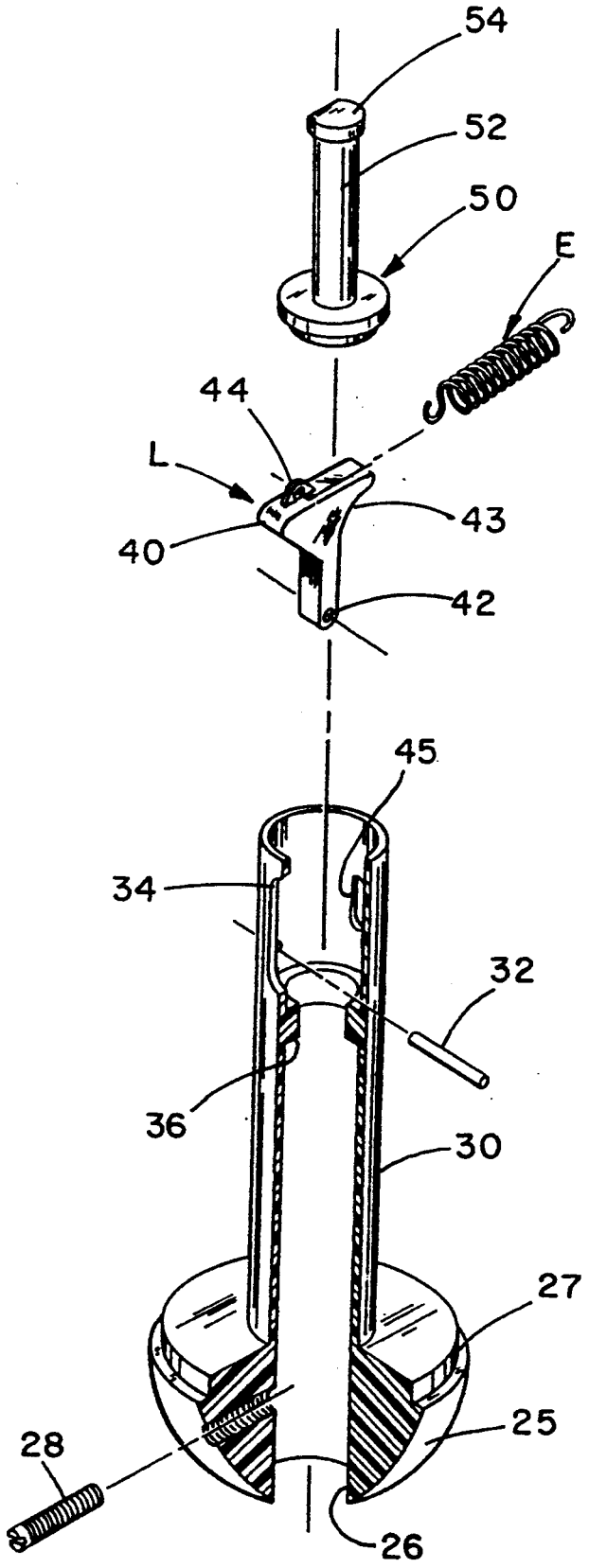
Figure 2E:
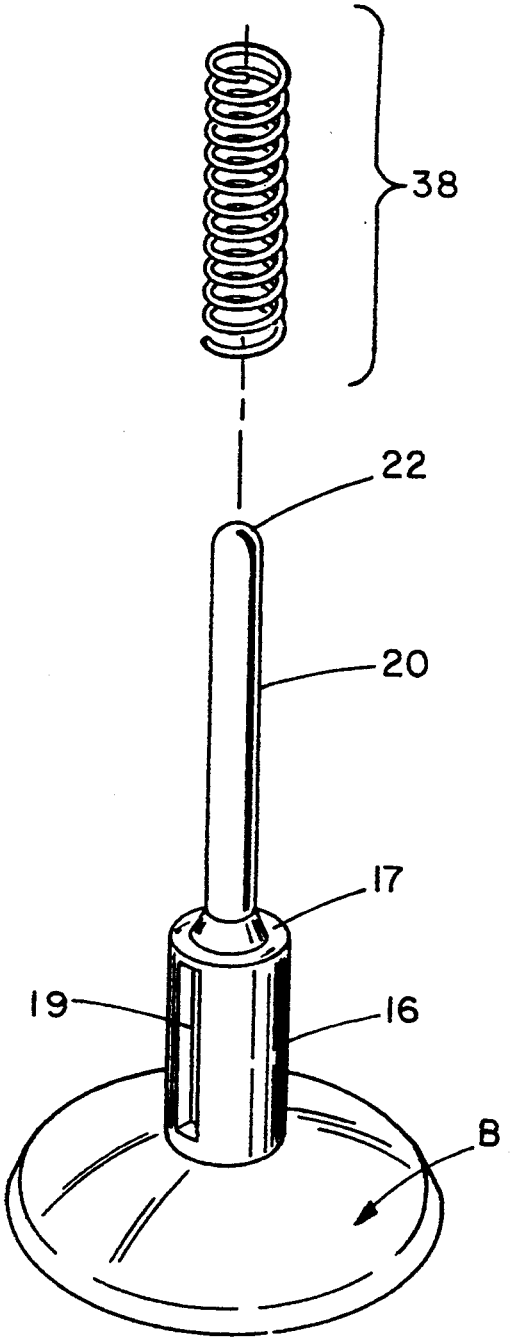

First, and with emphasis on the right hand column of exploded parts of FIG. 2, the actuation of a lever for at least partially depressing a blister to cause dispensing of an oral solid drug from a blister of a blister pack will be set forth.

Secondly, and with emphasis on the middle column of exploded parts of FIG. 2, attention will be devoted to the rotational registration of the sequential blisters of a row of blisters to the dispensing window W. The reader will understand that when such registration occurs, the lever referred to in the preceding section can effect the dispensing.

Thirdly, and with emphasis on the left hand column of exploded parts of FIG. 2, the vertical registration of discrete rows of blisters to the elevation of the dispensing window will be set forth.

Finally, and with reference to FIG. 4, loading of the dispenser with a blister pack will be described.

Actuation of Dispensing Lever

Figure 3:
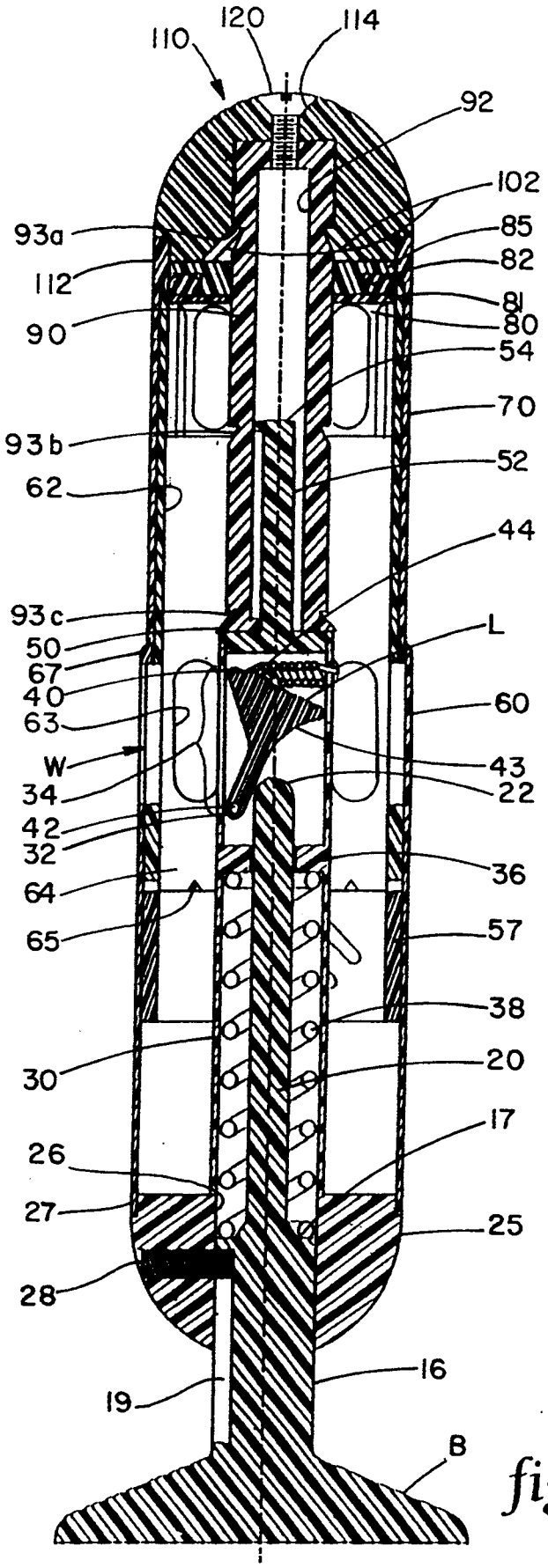
FIG. 3 is a side elevation section of the dispenser.

Referring to FIGS. 2 and 3, circular base B is illustrated having upward central shaft 16 terminating in spring support shoulder 17. Slot 19 is provided in shaft 16 to prevent relative rotation between base B and the adjacent portions of the dispenser.

Integrally connected to base B and at the upper end of central shaft 16 there is provided cam rod 20. Cam rod 20 terminates at an upward cam 22. As will here after be made clear, cam 22 actuates the bubble depressing lever L for dispensing an oral solid drug from the blister pack P (see FIGS. 2, 4–7).

Continuing with FIGS. 2 and 3, the bottom of dispenser container includes a hemispherical lower cover 25 having a central axial bore 26 with upper shoulder 27 for engaging the bottom of outer sleeve 60.

Extending upward from hemispherical bottom cover 25 there is lever cylinder 30. Lever cylinder includes a spring stop 36, bores for allowing pivotal attachment of the lower portion of the lever L, and a window 34 for enabling lever L to depress an exposed blister for effecting dispensing of a contained oral solid drug.

There is shown schematically at the top of lever cylinder 30 a spring E. This spring E attaches between attachment point 44 and window 45 in lever cylinder 30 and normally biases lever L away from window 34. Thus only when cam rod 20 at cam 22 actuates lever L, does the rocking dispensing motion of lever L out of window 34 occur.

Coil spring 38 is provided. Spring 38 fits over cam rod 20 between shoulder 17 and within lever cylinder 30 against spring stop 36. This spring has the function of biasing cam 22 at the end of cam rod 20 away from lever L so that the lever remains biased by spring E out of window 34 in lever cylinder 30. Spring stiffness is sufficient to support a loaded dispenser upwardly biased away from base B.

Lever L is easily understood. It includes a blister contacting portion 40, a lower pivot aperture 42, an attachment point 44 for spring E and an actuating follower cam surface 43.

Figure 4:
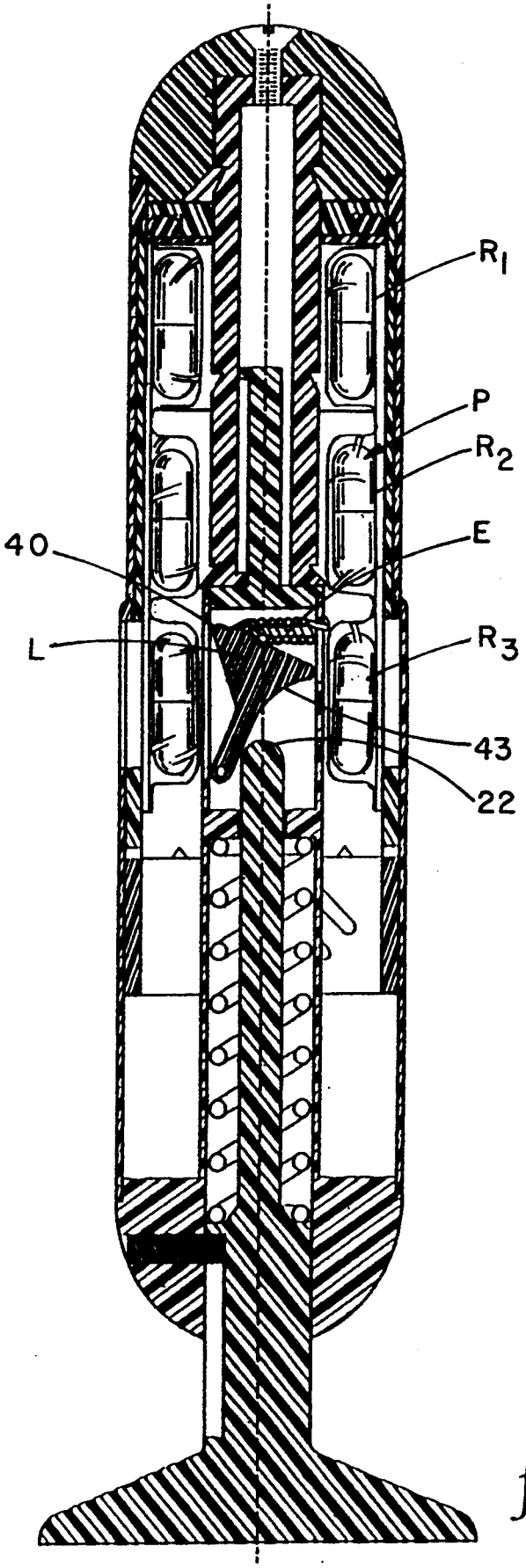
FIG. 4 is a side elevation section of the dispenser similar to FIG. 3 illustrating the device loaded with a blister pack and just before the dispensing of a first oral solid drug.
Figure 5:
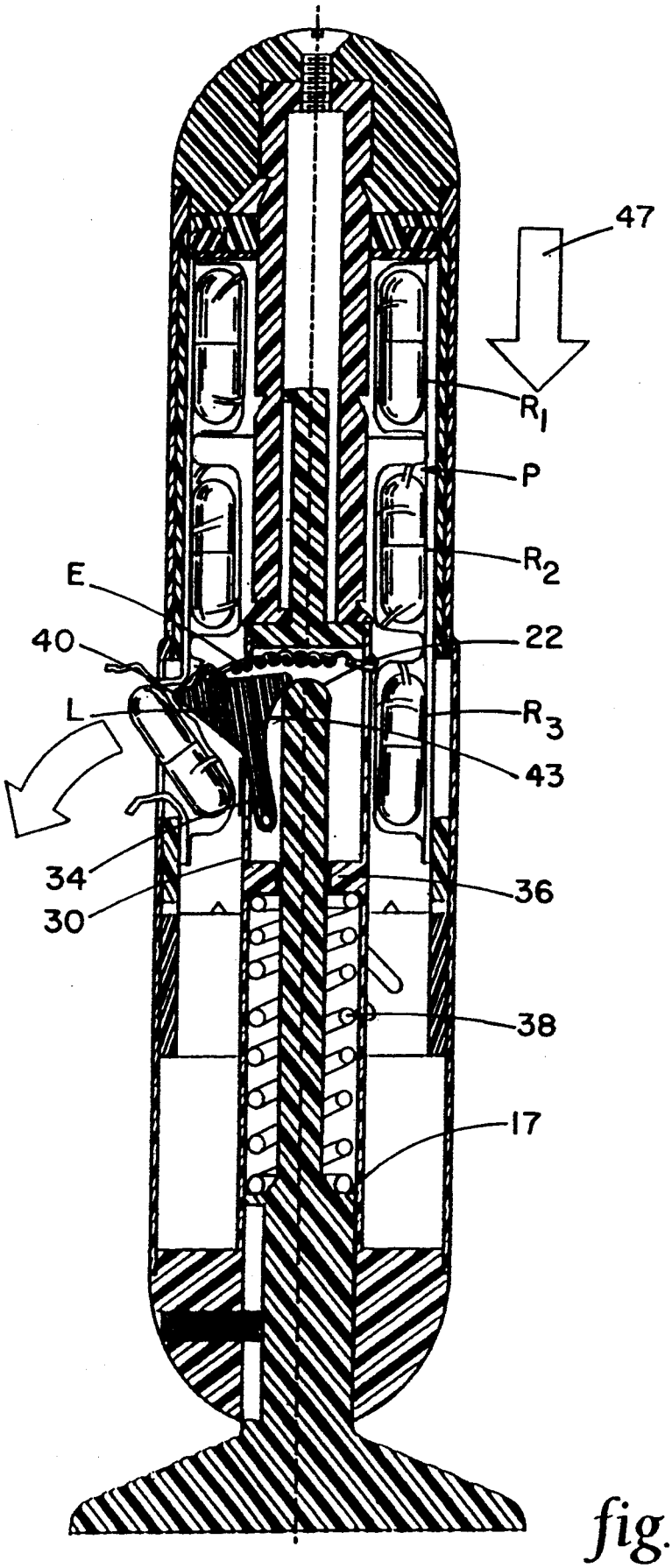
FIG. 5 is a side elevation similar to FIG. 4 illustrating the device in the process of dispensing an oral solid drug.

Having progressed this far, and specifically referring additionally to FIGS. 4 and 5, actuation of lever L in a dispensing motion is easy to understand. Lower cover 25 is moved downward with respect to base B in the direction of arrow 47. Spring 38 collapses between shoulder 17 and spring stop 36. Cam 22 on cam rod 20 passes along cam follower surface 43 of lever L and urges the lever L away from the path of cam 22. Consequently, lever L rocks forward and protrudes out lever window 34 in lever cylinder 30. Providing that the lever L overlies an exposed and registered blister overlying dispensing window W in a blister pack, dispensing of a contained oral solid drug would occur.

Registration of Blisters to Dispensing Window

Having set forth actuation of lever L, attention can now be devoted to the rotation registration of successive blisters in a blister pack row to dispensing window W.

Fitted over the end of lever cylinder 30, is cap 50 which closes lever cylinder 30. A limit column 52 extends upward from cap 50 and defines a bearing surface 54. As will be described here after, bearing surface 54 extends interiorly of concentric bore 92 in timing column 90.

Rotational rachet collar 57 with defined angular extending rachet spring 58 is the device against which incremental rotation is effected. This collar is fixed in rotation with respect to base B.

Cage sleeve 62 includes an upper sleeve member 61 forming an inside diameter. It is against this inside diameter that cage 80 at O-ring 82 slides. As will be emphasized here after, friction from O-ring 82 enables vertical registration of successive rows in a blister pack for sequential dispensing. Cage sleeve 62 further includes a lower windowed portion 64. This windowed portion defines a series of windows 63 which usually equal that number of blisters in a discrete row of a blister pack to be dispensed.

Finally, at the bottom of cage sleeve 62 there is rachet slots 65. These respective slots 65 ratchet with rachet spring 58 to enable one way blister incremental registration of each window 63 with dispensing window W. It will be understood that this member is rotationally affixed to the upper portion of the container so that relative rotation can occur between base B and container C.

Lower sleeve 60 fits over upper sleeve member 61 and rides at ridge 67 at the shoulder defined between cage portion 64 and upper sleeve member 61. This member defines dispensing window W. Consequently, it is fixed in relative rotation to rotate with base B. This fixing in relative rotation occurs groove 27 in lower cap 25.

Upper sleeve 70 fits over the top of upper sleeve member 61. This member is rotationally attached to cage sleeve 62.

Having gone this far, the relative rotation of the dispensing window W with respect to the discrete windows 63 in cage sleeve 62 can be understood. Referring to FIGS. 2 and 3, lower sleeve 60 and upper sleeve 70 are rotated in counter directions. Lower sleeve 60 is rotated counterclockwise; upper sleeve 70 is rotated clockwise. Rachet spring 58 imparts tactile perception as each discrete window 63 registers with dispensing window W. It this will be understood that continued rotation can occur to dispense all oral solid drugs from the blisters of any discrete row of a blister pack P.

Vertical Registration of Blister Pack Rows

It will be remembered that cage member 80 has an O-ring 82. This O-ring 82 fits within an O-ring slot 81 at the top of cage member 80 defined between cage top 85 and the upper member of cage member 80. Cage member 80 also defines a plurality of cage openings 83. Specifically, these respective cage openings 83 are usually equivalent in number to the total number of blisters within a row of a blister pack P. Cage member top 85 is held to cage member 80 by four screws 130*a*, 130*b*, 130*c* and 130*d*. The special case of screw 130*a* will not be considered at this time; the roll in fastening cage member top 85 to trap O-ring 82 is conventional.

It should also be realized that precise correspondence between the individual blisters of a blister pack row and the number of cage openings 83 is not required. All that is required is that the cage have sufficient dimension to key to at least one of the blisters. Thereafter, and when the blister pack is wrapped about cage member 80, registration sufficient for the practice of this invention would follow.

Timing column 90 has an outer notched surface. These notches include notch 93*a* for the lower blister pack row, notch 93*b* for the middle blister pack row, and notch 93*c* for the upper blister pack row. Interior, timing column 90 includes surface 92 for centering rotation of the upper portion of the dispenser relative to the lower portion of the dispenser. Finally, and at the top, timing column defines a threaded aperture 94 for fastening the unit together.

C-shaped leaf spring 100 is provided. Leaf spring 100 has opposed leafs 102, which leafs function to travel over notches 93*a*, 93*b*, and 93*c* as the respective lower, middle and upper blister pack rows are dispensed.

Finally, the full assembly is completed by upper cap 110. Upper cap 110 defines lower ridge 112 which bears against the upper surface of upper sleeve 70. This member includes a central counter sunk bore 114 which accommodates screw 120 holding the upper portion of the dispenser into a unitary assembly.

It is desired to have the unit assembled and dissassembled by authorized personnel only. This being the case, bore 92 has integral flange 96 with a chord of the flange missing. This flange 96 can permit passage of external flange 54 which likewise has a complementary chord missing. When external flange 54 fits interiorly of bore 92 past integral flange 96, this limits the upward travel of column 90 provided that registry of the complimentary chords does not occur, avoiding accidental separation of the unitary assembly.

The respective complementary chords in integral flange 96 and external flange 54 are configured to pass each other at only one rotational orientation. This allows the timing column 90 to be removed from the dispenser at only this precise rotational alignment.

It is necessary that timing column 90 take cage 80 with the column upon removal. This enables cage 80 to be reloaded with a new blister pack P. Therefore, flange 93*c* on timing column 90 is sized so that it will not pass through the central bore of cage 80. Thus removal of timing column 90 will withdraw the cage and depleted blister pack P allowing for its replacement.

Figure 6:
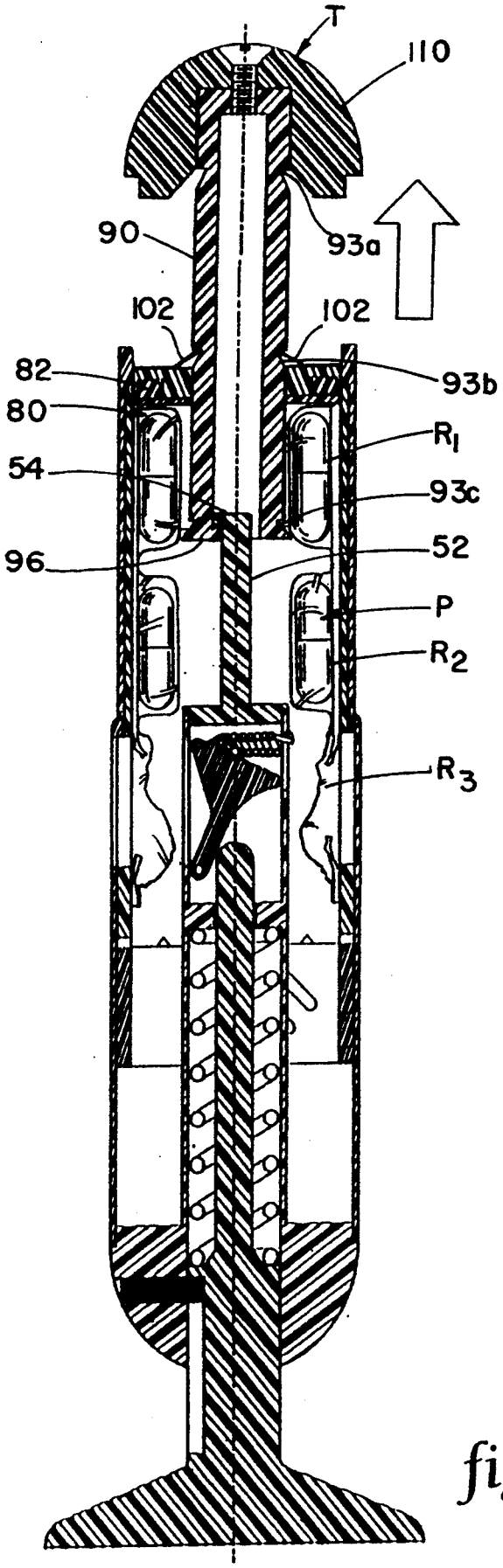
FIG. 6 is a side elevation similar to FIG. 5 illustrating the device in the process of having the top elevated for indexing the intermediate row of the blister pack for dispensing; and, FIG. 7 is a side elevation similar to FIG. 6 illustrating the device with the top depressed to the regular dispensing elevation with the device now oriented to dispense the oral solid drugs from the intermediate row of the blister pack.
Figure 7:
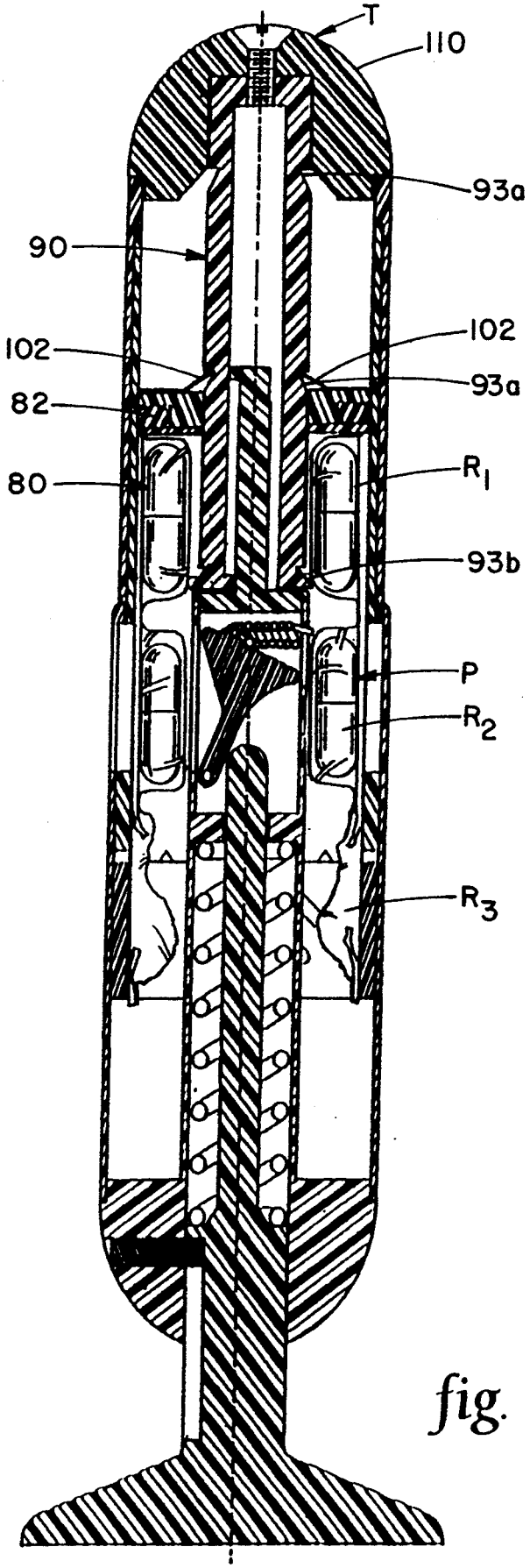

Having completed the description, and referring to FIGS. 6 and 7, the vertical registration can be understood. Referring to the view of FIGS. 3, 4, and 5, it will be understood that this is the disposition when it is initially loaded with a blister pack P. Cage member 80 is engaged to the upper row of the blister pack P; the lower row of the blister pack extends and is registered at its respective blisters to windows 63 in cage sleeve 62. Assuming that the lower row is completely dispensed, vertical movement must occur to permit further dispensing from the middle row of the loaded blister pack.

In this case, cap 110 is moved upwardly in the direction of arrow 98 (See FIG. 6). Cage 80, due to the friction created by O-ring 82 remains at its original elevation. Opposed leaf spring members 102 slide over the outside surface of timing column 90. Movement continues until a tactile proprioception of spring 102 coming into contact with notch 93*b* occurs.

Upon this proprioception, the operator then pushes down on cap 110 in a direction opposite to arrow 98 (See FIG. 7). Springs 102 remain fixed in notch 93*b*. Instead, cage 80 overcomes friction of O-ring 82 on the inside of cage sleeve 62. As a result, cage member 80 is notched vertically downward for the registration of middle blister row with dispensing window W. Thereafter, rotation and dispensing of the middle row occurs.

This process is repeated for dispensing of the upper row of the blister pack with respect to notch 93*c*. During this dispensing it will be understood that lever L at blister contacting portion 40 extends through window 34 and also through the windows 83 defined by the cage member 80.

Loading of the Dispenser

Referring to FIG. 2, it will be understood that cage member 80 includes the unusual case of screw 130*a*. Likewise, C-shaped leaf spring member includes an aperture 131 for fitting over screw 130*a*.

It further will be understood that when dispensing of all rows of the blister pack P has occurred, it is necessary to move opposed leaf spring member 102 from notch 93*c* on timing column 90 to notch 93*a*. As the opposed leaf spring members 102 engage notch 93*c* opposite such movement, removal of the springs from the shaft is required. It will be remembered that this removal will only occur in one angular alignment. This angular alignment is when chord of flange 54 is registered to the complimentary flange 96 in timing column 90.

Once this correct rotational alignment has occurred, C-shaped spring 100 is pivoted at the opening in the "C" away from timing column 90. Thereafter, upward movement of cage member 80 occurs until registration occurs with leafs 90 in groove 93*a*. Thereafter, the C-shaped spring is returned to its engagement with timing column 90 and the dispenser is ready for loading.

Loading of the dispenser is easily understood. Specifically, cage member 80 is removed from upper sleeve member 62. There after, a blister pack P having upper blister row $R_1$, middle blister row $R_2$, and lower blister row $R_3$ is wrapped around cage member 80. This occurs with the discrete blister facing inward to and toward cage member 80. This disposes the outside of the blister pack P in an essentially cylindrical configuration.

All that remains is to place the now cylindrical blister pack interior of cage sleeve 62. First, the respect flanges 54 and 96 are rotated to their passing alignment. Thereafter, and with the axially extending portion of the blister pack and the lower blister pack row $R_3$ leading the way, the blister pack is inserted interiorly of the dispenser. From this point, dispensing occurs as previously described.

What is claimed is:

1. A combination dispenser and blister pack for receiving and dispensing a plurality of doses of oral solid drugs, each dose contained within one of a plurality of blisters of the blister pack, said blister pack having a first length, said blister pack comprising:

a layer defining said plurality of blisters formed in rows and columns of discrete blisters, each blister having a convex side disposed to one side of said layer and a concave side disposed to the opposite side of said layer, each said blister defining a concavity sufficient for receiving and retaining a singulated dose of said oral solid drug, discrete singulated oral solid drugs placed in each said blister and a retaining break away layer placed over said concave side of said blisters for retaining said oral solid drugs to said blisters, said dispenser for said blister pack comprising in combination:

a cylindrical cage defining at least one recess for keying to one or more of said blisters, said cage having a circumference at least equal to said first length to permit said blister pack to be wrapped around said cage in a cylindrical disposition defining a diameter;

a cylindrical dispenser container having a cylindrical inside dimension sufficient to receive the cage with said blister pack disposed over said cage;

said cylindrical container having a cylindrical side wall with a dispensing window formed therethrough;

means for registering successively to said dispensing window discrete blisters from said blister pack; and, means for depressing said blisters overlying said dispensing window for causing oral solid drugs within a blister overlying said dispensing window to be dispensed from said blister through said window.

2. An oral solid drug dispenser, for use with a blister pack of the type having a plurality of blisters containing doses of oral solid drugs, the dispenser comprising:

a cylindrical cage defining at least one recess for keying to one or more of said blisters with said blister pack wrapped around said cage in a cylindrical disposition;

a cylindrical dispenser container having a cylindrical inside region for receiving said cage with said blister pack disposed over said cage;

said cylindrical container having a cylindrical sidewall with a dispensing window formed therethrough;

means for registering successively to said dispensing window discrete blisters from said blister pack; and means for depressing said blisters overlying said dispensing window for causing oral solid drugs within a blister overlying said dispensing window to be dispensed from said blister through said window, wherein said means for depressing said blisters comprises:

a pivoted lever normally biased away from a blister overlying said dispensing window and moveable toward said window to depress a blister registered overlying said window a sufficient amount to at least partially dispense an oral solid from said blister; and, a cam rod for actuating said lever, said cam rod normally biased away from actuating said lever to depress said blister.

3. The dispenser of claim 2 and wherein:

said cam rod extends axially of said dispenser container to the exterior of said dispenser container; and, a base mounted to the distal end of said cam rod for the vertical support of said dispenser container whereby dispensing of an oral solid can occur responsive to movement of said base relative to said dispenser container.

4. A method of receiving and dispensing oral solid drugs from a blister pack wherein said blister pack includes, a layer formed with rows and columns of discrete blisters, each blister having a convex side disposed to one side of said layer and concave side disposed to the opposite side of said layer, each said blister defining a concavity sufficient for receiving and retaining a singulated oral solid drug;

discrete singulated oral solid drugs placed in each said blister; and, a retaining break away layer placed over said concave side of said blisters for retaining said oral solid drugs to said blisters;

said method comprising the steps of:

providing a cylindrical cage defining at least one recess for keying to one or more of said blisters, said cage having a sufficient cylindrical dimension to permit said blister pack to be wrapped around said cage in a cylindrical disposition;

wrapping said blister pack about said cylindrical cage with said blisters disposed inwardly towards said cage whereby said blister pack forms a cylindrical disposition with a cylindrical diameter;

providing a cylindrical dispenser container having a cylindrical inside dimension sufficient to receive the outside cylindrical diameter of said blister pack as disposed over said cage;

defining through the cylindrical side wall of said cylindrical dispenser container a dispensing window having a dimension sufficient to permit an oral solid drug dispensed from said blister pack to pass through said dispensing window;

successively registering to said dispensing window discrete blisters from said blister pack; and, providing means for depressing said blisters overlying said dispensing window for causing oral solid drugs within a blister overlying said dispensing window to be dispensed from said blister through said window.

5. The method of receiving and dispensing oral solid drugs from a dispenser according to claim 4 and wherein said successively registering step includes:

vertically registering said cage with respect to said dispensing window whereby discrete rows of said blister pack may be registered to the elevation of said dispensing window for dispensing of oral solid drugs from said blister pack.

6. The method of receiving and dispensing oral solid drugs from a dispenser according to claim 4 and wherein said successively registering step includes:

relatively rotating said cage and said dispensing window whereby discrete blisters in a row of said blister pack may be registered to the dispensing window for dispensing oral solid drugs from said blister pack.

7. An oral solid drug dispenser, for use with a blister pack of the type having a plurality of blisters containing a plurality of doses of oral solid drugs, said dispenser comprising:

a cylindrical cage defining at least one recess for keying to one or more of said blisters with said blister pack wrapped around said cage in a cylindrical disposition;

a cylindrical dispenser container having a cylindrical inside region for receiving the cage with said blister pack disposed over said cage;

said cylindrical container having a cylindrical side wall with a dispensing window formed therethrough;

means for registering successively to said dispensing window discrete blisters from said blister pack;

means for depressing said blisters overlying said dispensing window for causing oral solid drugs within a blister overlying said dispensing window to be dispensed from said blister through said window; and, means connecting said cage and said cylindrical dispenser container for vertically registering said cage with respect to said dispensing window whereby successive rows of oral solid drugs in said blister pack may be dispensed.

8. An oral solid drug dispenser, for use with a blister pack of the type having a plurality of doses of oral solid drugs, each dose contained within one of a plurality of blisters defining a plurality of rows of oral solid drugs within the blister pack, the dispenser comprising:

a cylindrical cage defining at least one recess for keying to or more of said blisters with said blister pack wrapped around said cage in a cylindrical disposition;

a cylindrical dispenser container having a cylindrical inside region for receiving the cage with said blister pack disposed over said cage;

said cylindrical container having a cylindrical sidewall with a dispensing window formed therethrough;

means for registering successively to said dispensing window discrete blisters from said blister pack;

means for depressing said blisters overlying said dispensing window for causing oral solid drugs within a blister overlying said dispensing window to be dispensed from said blister through said window;

means connecting said cage and said cylindrical dispenser container for vertically registering said cage with respect to said dispensing window whereby successive ones of said rows of oral solid drugs in said blister pack may be dispensed, said means for vertically registering said cage comprising:

a central notched shaft connected between said cage and said dispenser container;

a spring attached to said cage and biased upwardly into contact with said shaft for providing connection between said notches on said shaft and said cage when said cage is moved in a first vertical direction with respect to said shaft and sliding over the notches in said shaft when said shaft is moved in a second opposite vertical dimension with respect to said cage; and, means for providing a frictional contact between said cage and said dispenser container whereby movement of said vertical shaft in a first direction enables said spring to slide over said shaft and movement of said vertical shaft in a second direction with respect to said cage overcomes said frictional bias of said cage and causes said cage to move with said shaft.

9. The dispenser of claim 8 and wherein:

said spring attached to said cage includes a C-sectioned profile for movement to and from a position of engagement with said shaft whereby when said spring is disengaged from said shaft, said shaft can be moved in said second vertical direction with respect to said cage.

10. An oral solid drug dispenser, for use with a blister pack of the type having a plurality of doses of oral solid drugs, each dose contained within one of a plurality of blisters of the blister pack, said dispenser comprising:

a cylindrical cage defining at least one recess for keying to one or more of said blisters with said blister pack wrapped around said cage in a cylindrical disposition;

a cylindrical dispenser container having a cylindrical inside region for to receiving the cage with said blister pack disposed over said cage;

said cylindrical container having a cylindrical side wall with a dispensing window formed therethrough;

means for registering successively to said dispensing window discrete blisters from said blister pack;

a lever overlying said dispensing window having movement between a first position away from said window and a second position towards said window for at least partially depressing said blister a sufficient dimension for at least partial ejection of said oral solid from said blister pack;

means normally biasing said lever away from said blister;

a vertically moving cam rod for overcoming said bias of said lever, said vertically moving cam rod having an upward excursion for causing said lever to depress said blister and a downward position for permitting said lever to move away from said blister.

11. The dispenser of claim 10 and wherein said vertically moving cam rod moves axially of said cylindrical dispenser container.

12. The dispenser of claim 11 and wherein said vertically moving cam rod includes a supporting base attached to said cam rod whereby movement of said base with resect to said cylindrical dispenser container enables said lever to depress said blister overlying said dispensing window.

13. An oral solid drug dispenser, for use with a blister pack of the type having a plurality of doses of oral solid drugs, each dose contained within one of a plurality blisters, said dispenser comprising:

a cylindrical cage defining at least one recess for keying to one or more of said blisters;

a cylindrical dispenser container having a cylindrical inside region for receiving the cage with said blister pack disposed over said cage;

said cylindrical container having a cylindrical sidewall with a dispensing window formed therethrough;

means for registering successively to said dispensing window discrete blisters from said blister pack; and means for depressing said blisters overlying said dispensing window for causing oral solid drugs within a blister overlying said dispensing window to be dispensed from said blister through said window.

14. The combination of a blister pack and a dispenser for receiving and dispensing oral solid drugs from the dispenser pack comprising:

a blister pack comprising:

a first layer formed with rows and columns of discrete blisters, each said blister defining a concavity sufficient for receiving and retaining a singulated dose of oral solid drug;

discrete singulated oral solid drugs placed in each said blister; and a retaining breakaway layer placed over said concavity for retaining said oral solid drugs within said blisters, said blister pack having a first length; and a dispenser for said blister pack comprising:

a cylindrical cage defining at least one recess for keying to one or more said blisters, said cage having a circumference at least equal to said first length to permit said blister pack to be wrapped around said cage in a cylindrical disposition defining a diameter;

a cylindrical dispenser container having a cylindrical inside dimension sufficient to receive the cage with said blister pack disposed over said cage;

said cylindrical container having a cylindrical sidewall with a dispensing window formed therethrough;

means for registering successively to said dispensing window discrete blisters from said blister pack; and means for depressing said blisters overlying said dispensing window for causing oral solid drugs within a blister overlying said dispensing window to be dispensed from said blister through said window.

15. An oral solid drug dispenser, for use with blister pack of the type having a plurality of doses of oral solid drugs, each dose contained within one of a plurality of blisters, said dispenser comprising:

a cylindrical cage defining at least one recess for keying to one or more of said blisters;

a cylindrical dispenser container having a cylindrical inside region for to receiving the cage with said blister pack disposed over said cage;

said cylindrical container having a cylindrical sidewall with a dispensing window formed therethrough;

a ratchet configured to register discrete blisters of said blister pack to said dispensing window;

a movable driver normally biased away from said dispensing window and movable toward said window to depress a blister registered with said window a sufficient amount to at least partially dispense an oral solid from said blister through said dispensing window; and a cam rod movable with respect to said movable driver between a first position biased away from said movable driver to a second position actuating said movable driver to depress said blister.

16. A combination oral solid drug dispenser and blister pack comprising:

a blister pack having a plurality of doses of oral solid drugs, each dose contained within one of a plurality of blisters, said dispenser comprising:

a cylindrical cage defining at least one recess having a size and shape permitting it to be keyed to one or more of said blisters;

a cylindrical dispenser container having a cylindrical inside dimension sufficient to receive the cage with said blister pack disposed over said cage;

said cylindrical container having a cylindrical sidewall with a dispensing window formed therethrough;

a ratchet configured to register discrete blisters of said blister pack to said dispensing window;

a movable driver normally biased away from said dispensing window and movable toward said window to depress a blister registered with said window a sufficient amount to at least partially dispense an oral solid from said blister through said dispensing window; and a cam rod movable with respect to said movable driver between a first position biased away from said movable driver to a second position actuating said movable driver to depress said blister.

* * * * *